US006829868B1

(12) United States Patent
Frey

(10) Patent No.: US 6,829,868 B1
(45) Date of Patent: Dec. 14, 2004

(54) GLAZING PANE INSTALLATION

(75) Inventor: John R. Frey, Riverside, CA (US)

(73) Assignee: International Aluminum Corporation, Monterey Park, CA (US)

( * ) Notice: Subject to any disclaimer, the term of this patent is extended or adjusted under 35 U.S.C. 154(b) by 9 days.

(21) Appl. No.: 10/340,893

(22) Filed: Jan. 14, 2003

(51) Int. Cl.[7] ..... E04C 2/38
(52) U.S. Cl. ..... 52/604.62; 52/204.7; 52/204.64
(58) Field of Search ..... 52/204.62, 204.64, 52/204.7, 204.5, 204.53, 204.59, 204.591, 204.595, 204.597, 204.71, 204.72, 476, 745.15

(56) References Cited

U.S. PATENT DOCUMENTS

| | | | | | |
|---|---|---|---|---|---|
| 1,686,162 | A | | 10/1928 | Lindersmith | |
| 2,046,251 | A | | 6/1936 | Daniels | |
| 3,404,501 | A | | 10/1968 | Von Wedel | |
| 3,881,290 | A | * | 5/1975 | Bouchey | 52/204.593 |
| 3,881,294 | A | | 5/1975 | Biebuyck | |
| 3,916,595 | A | | 11/1975 | Biebuyck | |
| 4,092,812 | A | | 6/1978 | Dashner et al. | |
| 4,843,773 | A | * | 7/1989 | Richter | 52/204.593 |
| 4,897,975 | A | * | 2/1990 | Artwick et al. | 52/208 |
| 4,984,839 | A | * | 1/1991 | Miyakawa et al. | 52/204.597 |
| 5,242,207 | A | * | 9/1993 | Carson et al. | 52/203 |
| 5,603,585 | A | * | 2/1997 | Bruchu et al. | 52/204.5 |
| 5,761,860 | A | * | 6/1998 | Koike et al. | 52/204.67 |
| 5,787,657 | A | * | 8/1998 | Librande et al. | 52/202 |
| 6,003,277 | A | * | 12/1999 | Graham et al. | 52/309.7 |
| 6,012,257 | A | * | 1/2000 | Caplette | 52/202 |
| 6,151,849 | A | * | 11/2000 | Twigg et al. | 52/208 |
| 6,581,342 | B1 | * | 6/2003 | Tavivian | 52/204.595 |

* cited by examiner

*Primary Examiner*—Peter M. Cuomo
*Assistant Examiner*—Stephen D'Adamo
(74) *Attorney, Agent, or Firm*—William W. Haefliger

(57) ABSTRACT

A method of installing a glazing pane in a frame that includes providing the frame with structure defining elongated grooves including a lower horizontal groove and left and right upright grooves, the pane having upper and lower horizontal edges, and left and right upright edges, maneuvering the pane to position the pane left and right upright edges in the respective frame structure left and right upright grooves, for retention therein, the pane then being lowered to position the pane lower horizontal edge is the frame lower horizontal groove, for retention therein, and providing a horizontally elongated stop member, carried by the frame to extend in retaining relation with the pane upper horizontal edge, blocking access to that edge from the front side of the frame.

6 Claims, 7 Drawing Sheets

GLAZING PANE INSTALLATION

BACKGROUND OF THE INVENTION

This invention relates generally to glazing methods and apparatus, and more particularly to efficient and rapid installation of glazing panes in door frames.

Such installation requires locating of pane edges in retained relation within pockets in bordering stop members. Those stop members typically include two vertical members and two horizontal members. In the past, it was necessary, in effect to assemble one or more of the four stop members about the edges of the glass pane, which required considerable time, work and effort by the workman installing the pane. For example, if the door was provided in assembled state, at least part of the stop members had to be removed, to allow fitting of the pane into grooves in all four stop members, which took extensive time. There is need for method and apparatus to substantially reduce the time and expense of glass pane assembly in a frame.

SUMMARY OF THE INVENTION

It is a major object of the invention to provide method and apparatus meeting the above need. Basically, the method of installing a glazing pane in a frame, in accordance with the invention, includes the steps:

a) providing the frame to have elongated grooves including a lower horizontal groove and left and right upright grooves, the pane having upper and lower horizontal edges, and left and right upright edges, b) maneuvering the pane to position the pane left and right upright edges in the respective frame left and right upright grooves, for retention therein, c) the pane then being lowered to position the pane lower horizontal edge is the frame lower horizontal groove, for retention therein, d) and providing a horizontally elongated stop member, and attaching that member to the frame to extend in retaining relation with the pane upper horizontal edge, blocking access to that edge from the front side of the frame.

It is another object of the invention to provide a stop attaching step which includes providing a hooking interfit connection of the stop member to the frame, to extend lengthwise of the stop member, and to block unhooking in response to pane movement toward the stop member. A non-metallic seal may then be easily provided between the stop member and the glazing pane, and in conjunction with establishment of the hooking interfit connection. Other non-metallic seals can also easily be established between surfaces of the frame and surfaces of the glazing panel, as for example lengthwise of the frame grooves, such seals positioned prior to pane maneuvering into final position.

A further object includes maneuvering edges of the glazing pane into upright left and right frame side member pockets or grooves, to establish a dimensional gap between those left and right grooves, which is less than the left to right dimension between the panel left and right edges. In this regard, such maneuvering typically first causes the pane left upright edge to angularly enter the frame left upright groove, and thereafter causes the pane right upright edge to enter the frame right upright groove. The pane lower horizontal edge is maintained above the level of the frame lower horizontal groove during said entry of the pane upright edges into the frame upright grooves, and thereafter the pane is lowered as defined in step c) of claim 1.

Yet another object is to provide a support such as a pane seating pad in the lower horizontal groove, to seat the pane lower horizontal edge as the pane is lowered.

An additional object includes employing hook together parts that complete their interfit to positively retain the stop member to the frame in overlapping relation to the pane upper horizontal edge.

In its apparatus aspects, the glazing pane and supporting frame assembly comprise:

a) frame integral elongated grooves including a lower horizontal groove and left and right upright grooves, the pane having upper and lower horizontal edges, and left and right upright edges, b) the pane maneuvered and positioned to cause the pane left and right upright edges to fit shallowly into the respective frame left and right upright grooves, c) the pane being lowered relative to the frame to cause the pane lower horizontal edge to enter into the frame lower horizontal groove, d) and there being a horizontally elongated stop member attached to the frame to extend in overlapping relation with the pane upper horizontal edge, blocking access to that edge from the front side of the frame.

The stop member typically has mechanical interfit connection to the frame, the connection extending lengthwise of the stop member; and the connection may include parts that hook together as the pane upper portion is finally positioned relative to the frame. In that position, there is a horizontal dimensional gap between the frame left and right grooves, which is less than the left to right dimension between the pane left and right edges, whereby the pane is retained in position along its upright and its horizontal edges.

These and other objects and advantages of the invention, as well as the details of an illustrative embodiment, will be more fully understood from the following specification and drawings, in which:

DRAWING DESCRIPTION

FIG. 1 is a frontal view of a door frame, with glazing installed;

FIG. 2*a* is a frontal view of a door frame, and showing an initial step during glazing installation;

FIGS. 2*b*–2*d* are like FIG. 2*a*, but showing subsequent steps during glazing installation;

DETAILED DESCRIPTION

Figure 7:
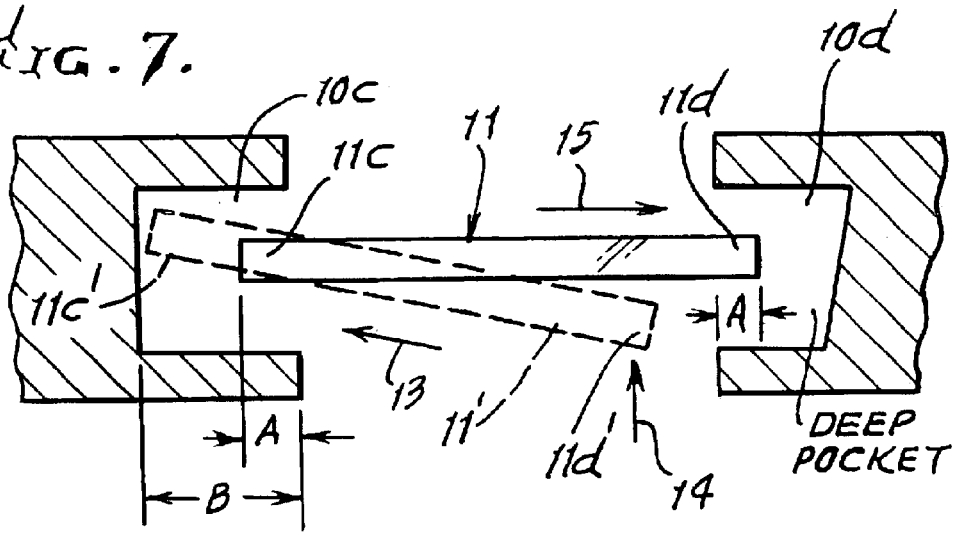
FIG. 7 is an enlarged schematic plan view taken in section through an upright frame member, and glazing during an initial installation step, corresponding to FIG. 2*a*.
Figure 8:
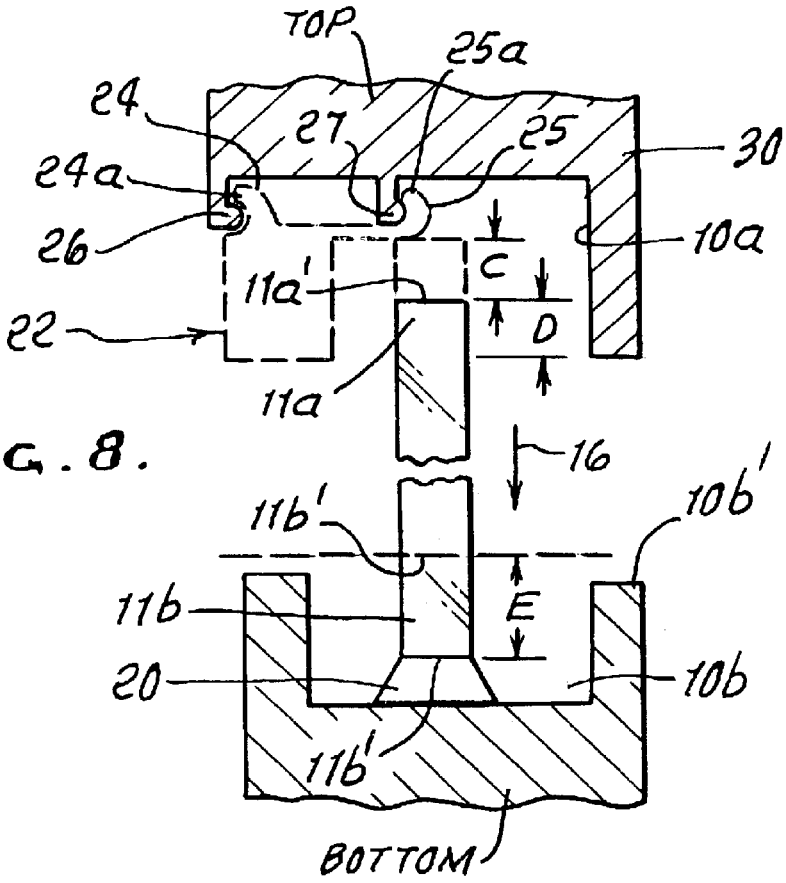
FIG. 8 is an enlarged schematic elevational view of the FIG. 7 frame and glazing, during completion of glazing installation, and corresponding to FIG. 3.

Referring first to the schematic views of FIGS. 7 and 8, they show steps in the preferred method of pane installation in accordance with the invention. A frame 10 is provided to receive a glazing pane 11. The pane has upper and lower horizontally elongated edge portions 11*a* and 11*b*, and left and right vertically elongated edge portions 11*c* and 11*d*. The frame has elongated grooves or retention zones (i.e. pockets) to receive such pane edges 11*b*, 11*c* and 11*d*. See lower groove 10*b* receiving pane edge portion 11*b*; and left and right vertically elongated grooves 10*c* and 10*d* receiving, or to receive, pane edge portions 11*c* and 11*d*, respectively.

FIG. 7 shows the pane in broken lines 11' being initially maneuvered to first angularly advance edge portion 11*c* deeply at 11*c*' into groove 10*c* (see arrow 13) while edge portion 11*d*' remains outside groove 10*d*; then to advance edge portion 11*d* in direction 14 into position between the two grooves 10*c* and 10*d*; then to advance the pane rightwardly in direction 15, to effect shallow reception of pane edge portion 11*d* in groove 10*d* and to maintain adjusted shallow reception of pane edge portion 11*c* in groove 10*c*. See the solid lines indicating the pane 11 adjusted position, in FIG. 7. As an example, the pane edge portions may be adjusted to cause them to penetrate the grooves to depths A, groove 10*c* having depth B greater than A, and to facilitate maneuvering as described. During such maneuvering, the pane lower edge portion 11*b* is maintained above the level of lower groove 10*b*. (See broken line 11*b*', in FIG. 8); and the pane upper edge portion 11*a* is in registration with frame upright wall 10*a*.

The pane is then lowered in direction 16 in FIG. 8, to position the pane lower edge portion 11*b* and lower edge 11*b*', in the frame lower horizontal groove 10*b*, for retention therein. As shown, the pane upper edge 11*a*' is lowered by an adjustable amount C, whereby lower edge 11*b*' comes to rest, and seats, on a support 20 in lower horizontal groove 10*b*. At this time the pane upper edge 11*a*' is spaced by an amount D above the lower edge 10*a*' of wall 10*a*. Pane lower edge 11*b*' is spaced by amount E below the upper edge 10*b*' of lower groove 10*b*. Typically, for best installation, D=E. At this point, there is no restraint frontwardly of the pane upper edge portion 11*a*.

The method also includes providing a horizontally elongated stop member, and attaching that member to the frame to extend in retaining relation with the pane upper horizontal edge, blocking access to that edge from the front side of the frame.

The schematic view of FIG. 8 shows one such stop member 22 moved into position retaining the pane upper edge portion 11*a* in space or zone 10*e* now defined between 22 and wall 10*a*.

Figure 3:
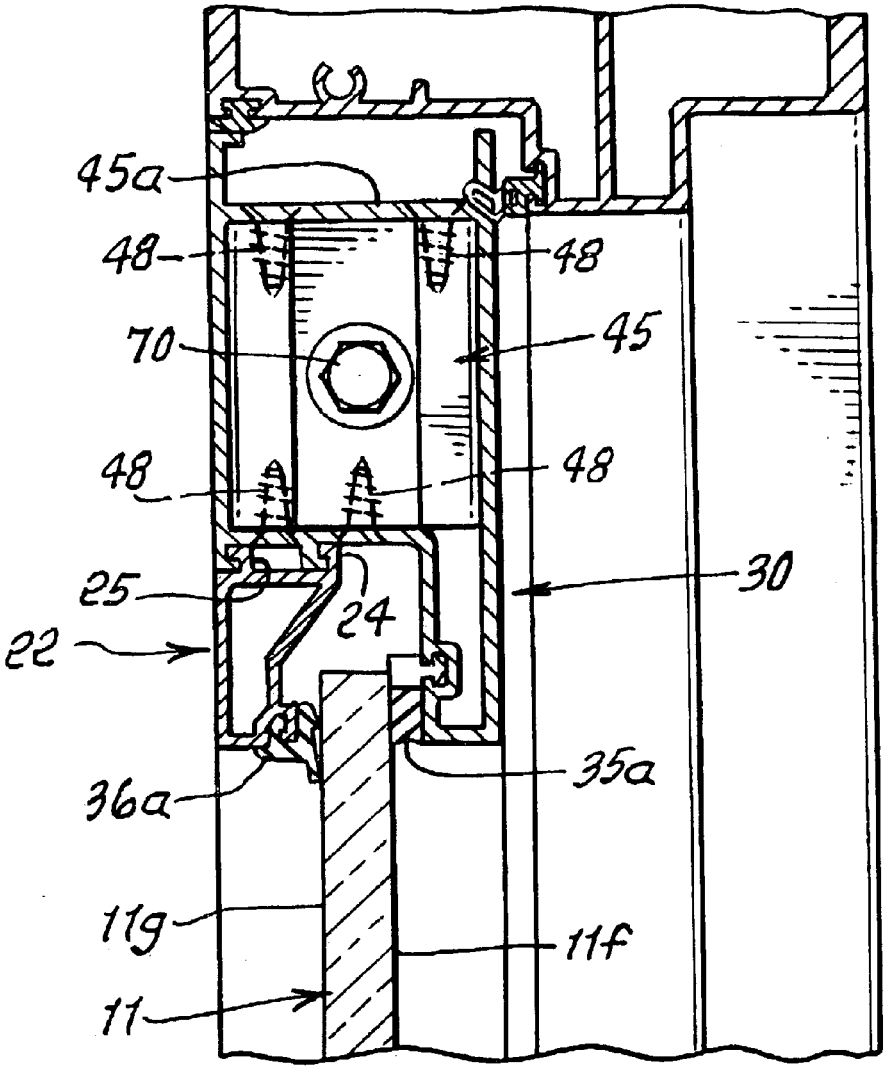
FIG. 3 is an enlarged elevation taken in section on lines 3—3 of FIG. 1.
Figure 4:
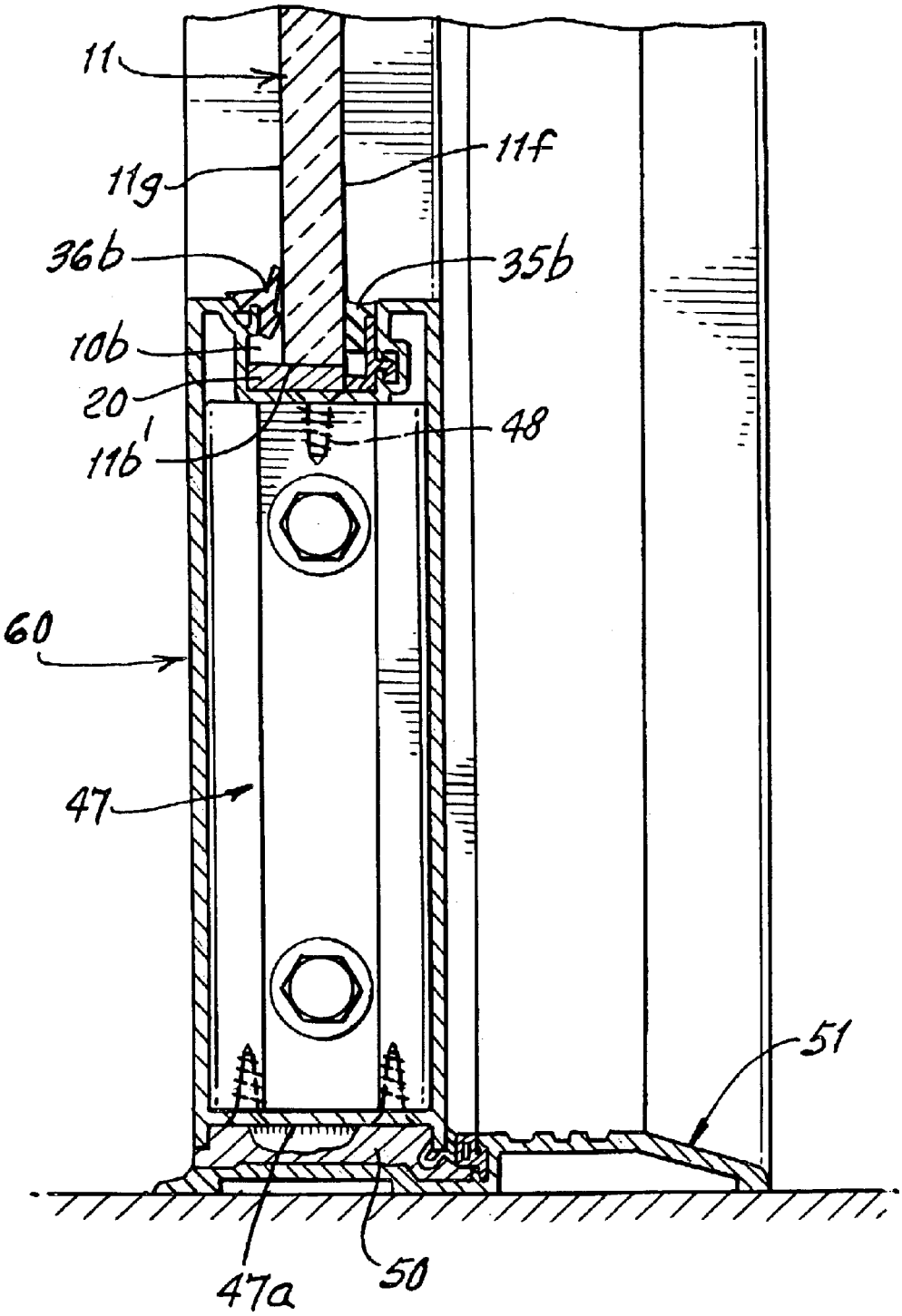
FIG. 4 is an enlarged elevation taken in section on lines 4—4 of FIG. 1.
Figure 5:
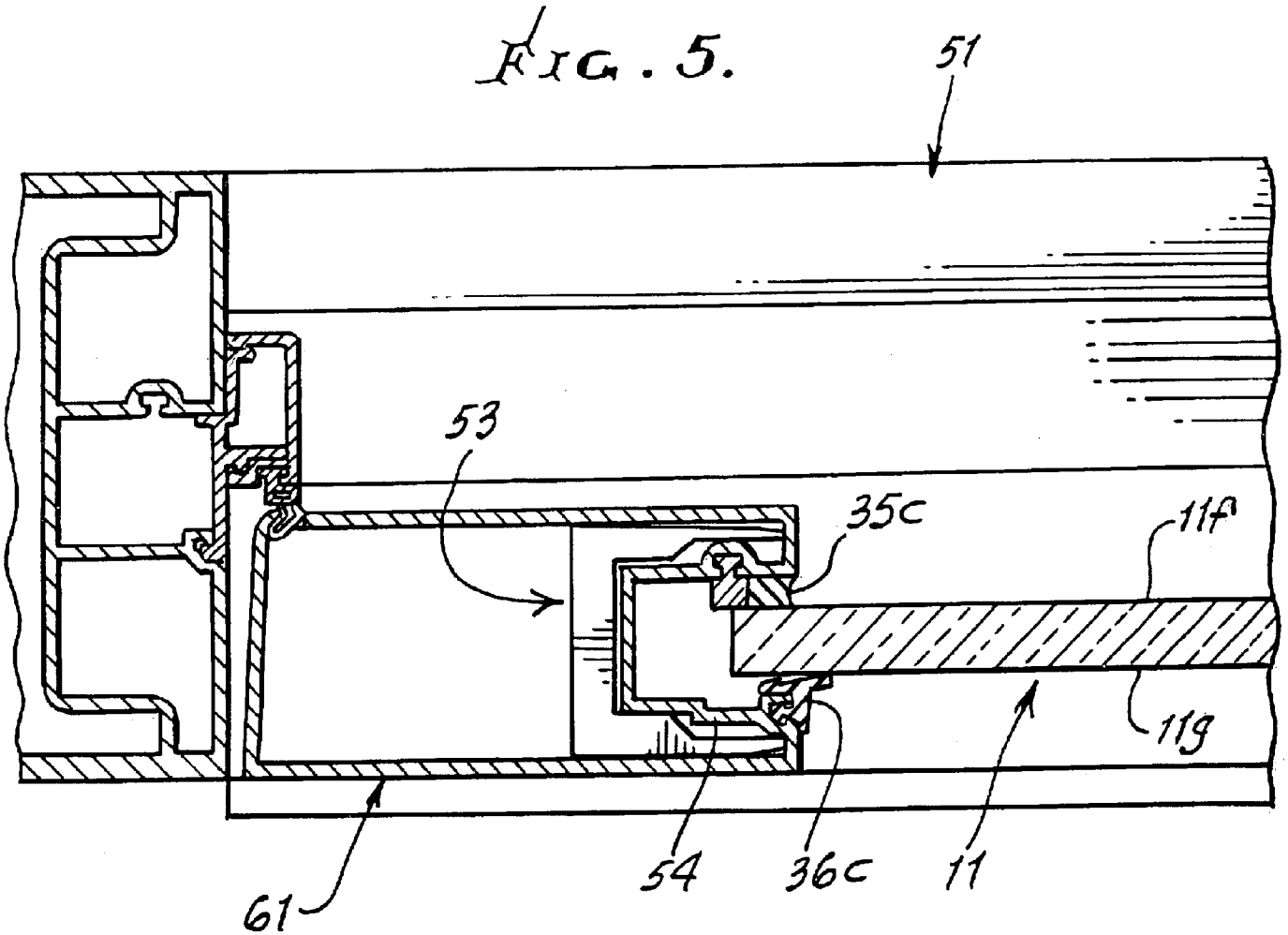
FIG. 5 is an enlarged plan view taken in section on lines 5—5 of FIG. 1.

As shown, the horizontally elongated stop member 22 preferably (but not necessarily) has a hook or hooks 24 and 25 that project upwardly and forwardly at 24*a* and 25*a* to hook into or onto downwardly projecting hooks 26 and 27 carried by the upper frame member 30 that carries wall 10*a*. Such hooking interfit assembly of stop member 22 to the frame facilitates rapid assembly, to retain the pane in lowered supported position, in which the pane can be surface clamped, as by non-metallic, and compressible seals to be described in connection with FIGS. 3–5, for safety purposes. See for example FIG. 3 showing silicone seal 35*a* and elastomeric seal 36*a*, carried by 30 and engaging or clamping opposite upper surfaces 11*f* and 11*g* of the panel 11; FIG. 4 showing silicone seal 35*b* and elastomeric seal 36*b* carried by horizontal frame member 60 engaging or clamping opposite lower portions of surfaces 11*f* and 11*g* of the pane 11; and FIG. 5 showing silicone seal 35*c* and elastomeric seal 36*c* carried by vertical frame member 61 engaging or clamping opposite surfaces of the left side of the pane. Similar seals carried by vertical frame member 62 are provided to engage the right side of the pane. The pane is maneuvered into position between such seals at the left and right sides of the pane and at the lower portion of the pane as it is lowered.

In FIGS. 1–6, top, bottom and side frame or rail members, are shown at 30 and 60–62. Attachment and supporting corner blocks are provided at 44–47, with suitable fasteners 48 to attach to frame structure as at 45*a* (FIG. 3) and 47*a* (FIG. 4).

Figure 2A:
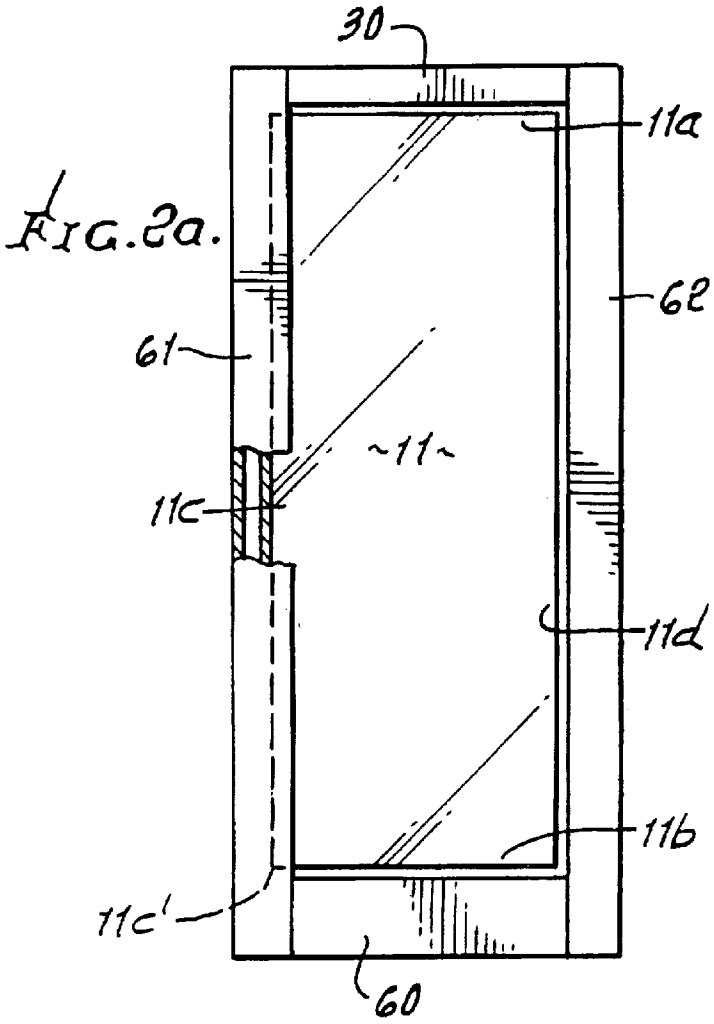
Figure 1:
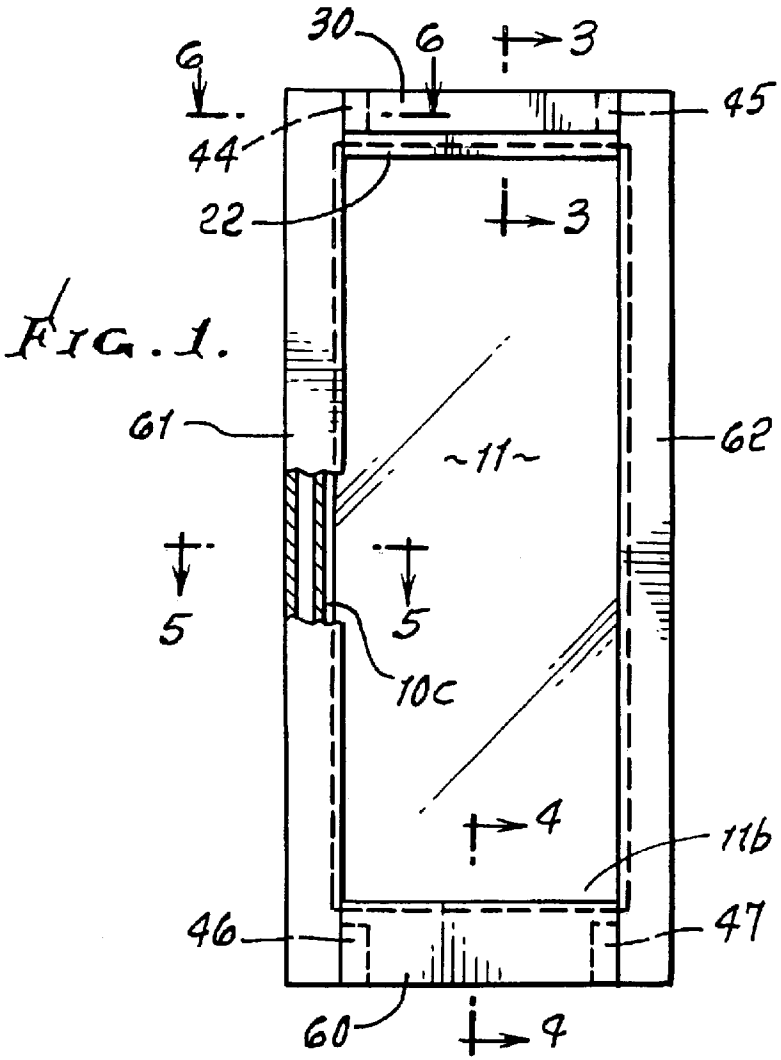
Figure 2D:
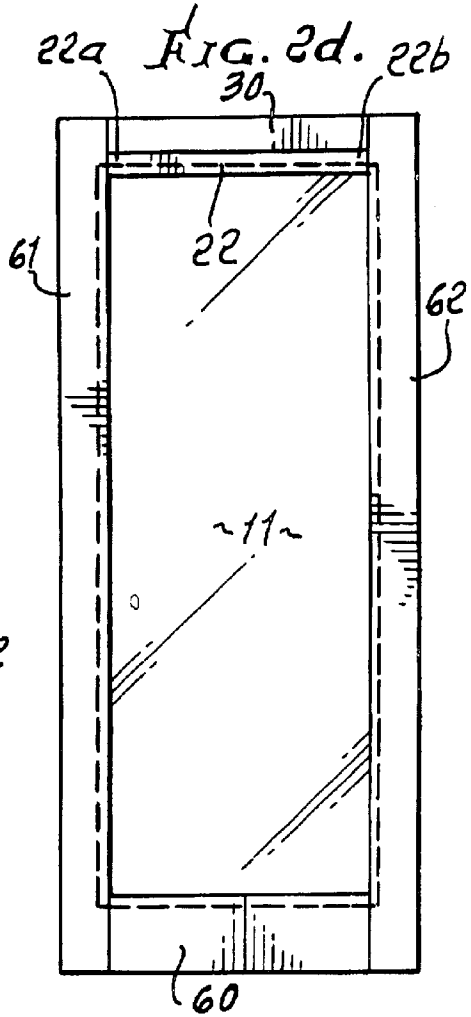
Figure 2C:
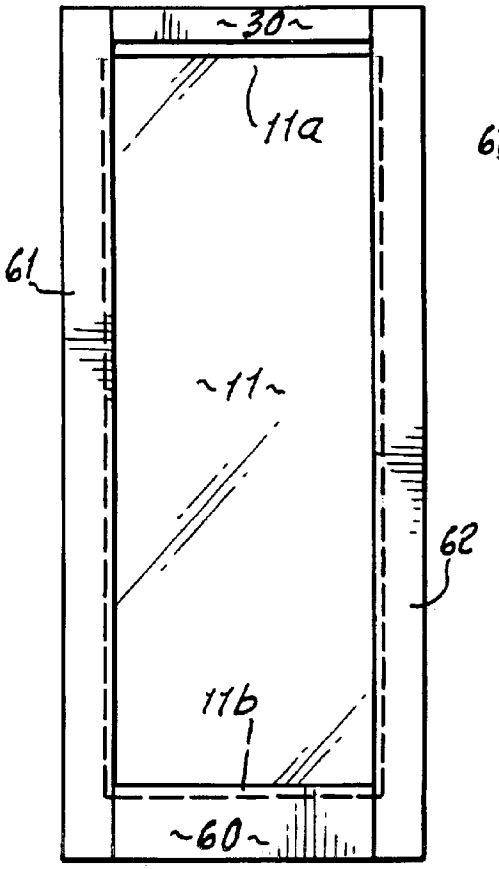
Figure 2B:
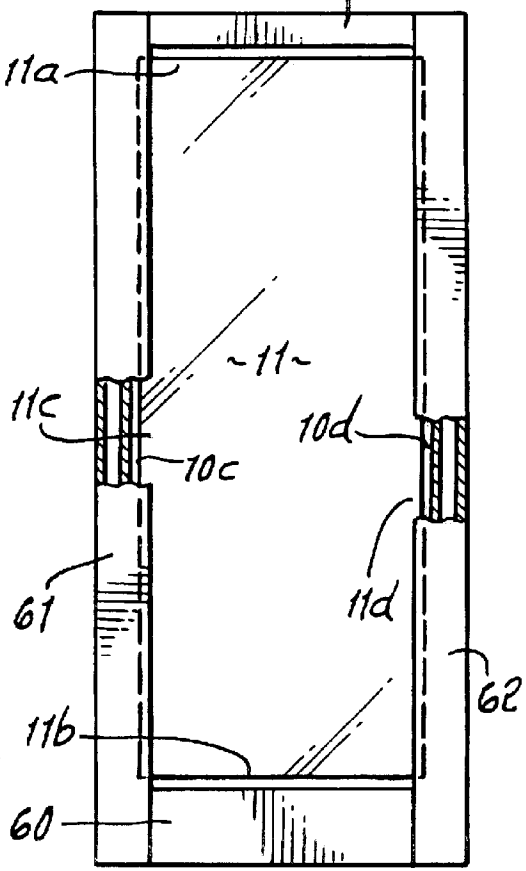

FIGS. 2*a* and 2*b* correspond to FIG. 7, with the same identifying numbers applied, and with the pane being centered in left and right grooves, 10*c* and 10*d* in FIG. 2*b*; FIG. 2*c* shows the pane lowered position as in FIG. 8; and FIG. 2*d* shows the upper stop member 22 applied to retain the pane upper edge portion in position. The direction of forward hooking in FIGS. 3 and 8 is such as to block unhooking in the event the pane is pushed forwardly. Opposite ends 22*a* and 22*b* of 22 fit between members 61 and 62. Attachments other t than hooking may be provided.

FIG. 4 also shows stile 50 and threshold 51 elements associated with the frame, and below the level of the pane. FIG. 5 shows a shear channel 53 carried by the frame side member 61, and centering the groove 10*c* defining channel structure 54, adding strength to the assembly.

Figure 6:
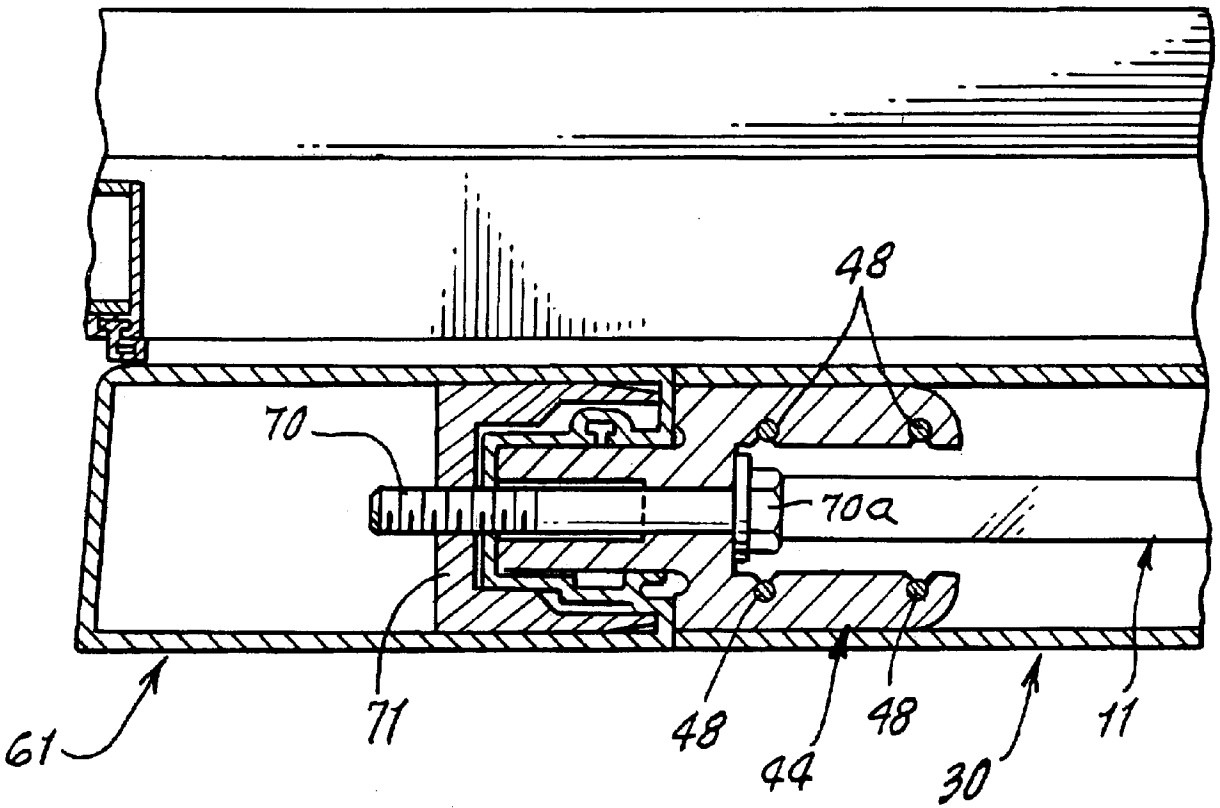
FIG. 6 is an enlarged plan view taken in section on lines 6—6 of FIG. 1.

FIG. 6 shows supporting of a corner block 44, as by a bolt 70 threadably received in a shear channel component 71 assembled to side rail or frame member 61. Pane 11 is below the level of the bolt head 70*a*.

I claim:

1. A glazing pane and supporting frame assembly comprising, in combination:

a) the frame carrying integral elongated grooves including a lower horizontal groove and left and right upright grooves, the pane having upper and lower horizontal edges, and left and right upright edges, b) the pane maneuvered and positioned to cause the pane left and right upright edges to fit into the respective frame left and right upright grooves, c) the pane being lowered relative to the frame to cause the pane lower horizontal edge to enter into the frame lower horizontal groove, d) and there being a horizontally elongated stop member carried by the frame to extend in overlapping relation with the pane upper horizontal edge, blocking access to that edge from the front side of the frame, e) said stop member having interfit connection to the frame, said connection extending lengthwise of the stop member, said connection including two upwardly protecting hooks carried by the stop member and two downwardly protecting hooks carried by the frame to interfit said upwardly projecting hooks, said downwardly projecting hooks having lowermost portions projecting forwardly toward a plane defined by the pane, said upwardly projecting hooks configured to hook over said lowermost portions, f) there being an elongated non-metallic seal carried by the hook suspended stop member to extend between the stop member and one side of the glazing pane, below the levels of said hooks.

2. The combination of claim 1 including non-metallic seals between surfaces of the frame and surfaces of the glazing panel, along and within said grooves.

3. The combination of claim 1 wherein there is a horizontal dimensional gap between said left and right grooves, which is less than the left to right dimension between the pane left and right edges.

4. The combination of claim 1 including a support pad in said lower horizontal groove, to seat the pane lower horizontal edge as the pane is lowered.

5. The combination of claim 1 of said upright and lower horizontal grooves are defined by structure carried by the frame.

6. The combination of claim 1 wherein said non-metallic seal is elastomeric and compressible, and there also being a silicone seal engaging the opposite side of said pain, said elastomeric and silicone seals extending horizontally at approximately the same level.

* * * * *